US008342664B2

(12) United States Patent
Wang

(10) Patent No.: US 8,342,664 B2
(45) Date of Patent: Jan. 1, 2013

(54) INK CARTRIDGE

(76) Inventor: Jie Wang, West Linn, OR (US)

( * ) Notice: Subject to any disclaimer, the term of this patent is extended or adjusted under 35 U.S.C. 154(b) by 207 days.

(21) Appl. No.: 12/660,265

(22) Filed: Feb. 22, 2010

(65) Prior Publication Data

US 2011/0205267 A1 Aug. 25, 2011

(51) Int. Cl.
*B41J 2/175* (2006.01)

(52) U.S. Cl. ..... 347/86; 347/85; 347/7

(58) Field of Classification Search ..... 347/7, 85, 347/86, 5

See application file for complete search history.

(56) References Cited

U.S. PATENT DOCUMENTS 6,170,937 B1 * 1/2001 Childers et al. ..... 347/85
6,877,846 B2 * 4/2005 Fellingham et al. ..... 347/85
7,192,109 B2 3/2007 Wang
7,328,986 B2 2/2008 Wang
7,918,549 B2 * 4/2011 Amano et al. ..... 347/86

* cited by examiner

*Primary Examiner* — Lam S Nguyen
(74) *Attorney, Agent, or Firm* — Jose R Mata Ho

(57) ABSTRACT

Any of an improved conventional, a refillable, or a continuous ink supply system (CISS) ink delivery apparatus, including a housing comprising one or more walls defining a chamber therein, a structural feature configured during use to detachably engage with a reciprocal receiving portion of a printer device, a fluid dispensing port extending through a first wall of the housing, and a siphon structure comprising a curved fluid-conducting conduit originating at the chamber and extending to the fluid dispensing port. Additionally and/or alternatively with respect to the siphon structure, an improved ink delivery apparatus includes any one or more of an automatically resettable chipset, a detachable cover plate and/or a fluid (gaseous and/or liquid) input port.

29 Claims, 6 Drawing Sheets

INK CARTRIDGE

FIELD OF THE INVENTION

The invention relates generally to the field of fluid delivery devices for digital printing. More particularly, the invention relates to an improved ink cartridge.

BACKGROUND OF THE INVENTION

Printing devices, referred to generally as printers herein for descriptive simplicity, are a nearly ubiquitous part of the modern world. Printers are used in every niche of society, from multi-national corporations and government entities, to elementary school students working on homework in the comfort of their homes. Among printer technologies, inkjet printers are one of the lower cost options, and therefore remain popular with consumers.

However, as users well know, replacement ink cartridges constitute a high, ongoing cost of ownership. Each cartridge has a limited usable life dictated primarily by its ink capacity. When no further ink can be usefully extracted, conventional ink cartridges must be disposed of and replaced. Periodically disposing of and replacing ink cartridges presents not only a substantial cost to the user, but also to the environment. Depleted ink cartridges are typically thrown away, after which their relatively non-degradable housings and chemical-containing inks end up in landfills. Further, producing replacement cartridges consumes a substantial amount of natural resources.

To reduce both the consumer cost and the environmental impact, numerous approaches have been developed to enable refilling of ink cartridges by the consumer or by a third-party. However, these efforts are both actively and passively discouraged by original equipment manufacturers (OEMs), who make a handsome income selling replacement ink cartridges for their printers.

Firstly, OEMs typically do not design ink cartridges to include provisions for relatively simple, clean, and reliable ink replenishment by the consumer. Rather, the consumer must use third-party tools and methods that typically breach the integrity of the ink cartridge, and are frequently difficult and messy to perform.

Secondly, OEMS typically do not provide a means for the consumer to reset the electronic chipset that counts ink dispense signals from the printer and indicates when ink in the cartridge may be low and/or empty. Therefore, although a consumer may successfully refill an ink cartridge, the chipset will continue to signal that the ink is low and/or empty.

Even when a consumer is able to successfully refill an ink cartridge, the internal design of conventional ink cartridges limits the amount of ink that can be provided therein. For example, conventional ink cartridges typically include an internal 'sponge' designed to distribute ink relatively evenly throughout the internal body of the cartridge. Thus, as ink is dispensed from one area within the cartridge, the dispensed ink is replaced by ink wicked through the sponge from another area of the cartridge body. However, this design has two cartridge-life-shortening deficiencies.

Firstly, the sponge itself consumes space within the cartridge body, thus reducing the amount of ink that can be contained therein. Secondly, when the amount of ink in the cartridge drops below the wicking capacity of the sponge, no further internal ink transfer occurs, despite the fact that ink remains in the cartridge. Thus, ink otherwise available for printing is wasted.

Further still, most ink cartridges provide for only a single mode of use. For example, conventional ink cartridges are designed to be used once and then discarded. Refillable ink cartridges produced by some third-party companies enable reuse, but still suffer from numerous problems, such as those inherent from inclusion of a sponge therein (as discussed above). Further still, neither conventional cartridges nor refillable cartridges are configured for use with a Continuous Ink Supply System (CISS).

Thus, existing ink cartridges, and indeed the structure of the OEM ink cartridge industry, entails elevated costs to consumers, and presents a tangible environmental burden. Thus far, incremental attempts fail to significantly alleviate either or both of these problems.

DETAILED DESCRIPTION OF THE PREFERRED EMBODIMENTS

Figure 1:
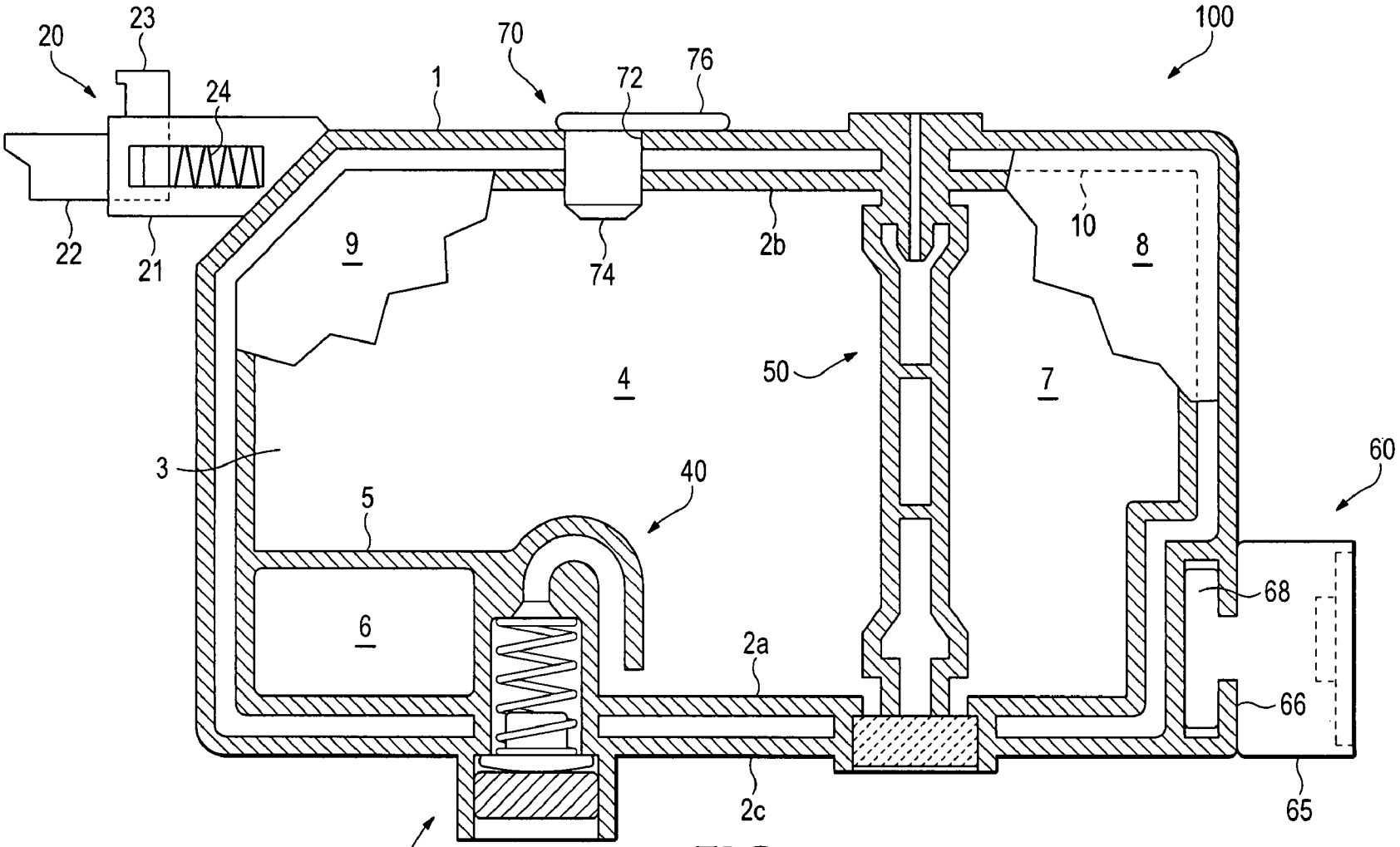
FIG. 1 depicts in cross-sectional view an ink delivery apparatus according to a preferred but not exclusive embodiment of the invention.

The novel ink cartridges described according to exemplary embodiments herein, and more broadly contemplated, include at least three types: conventional, refillable, and Continuous Ink Supply System (CISS). Conventional ink cartridges are generally designed to be used once and then discarded when the ink is nearly or fully depleted. Some available products and/or services allow refilling of conventional ink cartridges, but for descriptive simplicity herein, a conventional cartridge is referred to as such herein if it was designed and constructed by the manufacturer to be a single use cartridge (e.g., without providing a designated refill port). Refillable ink cartridges are designed for repeated use, wherein the depleted ink can be replaced either by the user or by a provider of such services. Typically, but not exclusively, a refillable cartridge must be removed from a printer prior to refilling.

Lastly, a CISS cartridge is designed to be coupled in relatively continuous fluid communication with a separate ink source (e.g., reservoir, pump, etc.) such that ink dispensed from the cartridge is replaced by ink from the ink source without removing the ink cartridge from the printer. Thus, a CISS can be used for relatively uninterrupted printing, provided a ready supply of ink is maintained at the separate ink source.

With regard to the figures and descriptions herein, it will be understood that the invention encompasses variations in the structure and arrangement of the numerous features according to alternative embodiments. The figures and descriptions herein represent exemplary embodiments, and are not exclusive of alternative forms that would be understood by one having ordinary skill in the art.

For example, although ink is utilized herein as an exemplary fluid for descriptive simplicity and clarity, the embodiments are not limited to use with ink alone. Rather, ink descriptively implies the suitability of the contemplated embodiments in conjunction with other fluids as well, as would be recognized by one having skill in the art.

Several terms are employed herein for descriptive simplicity. For example, the term 'may' herein connotes an allowance for variation between alternative embodiments, not uncertainty or ambiguity with regard to a described feature. Likewise, the term 'relatively', in addition to being used in a comparative sense (e.g., 'x is relatively longer than y'), is also used herein to indicated flexibility for a described condition and/or characteristic (e.g., dimension, shape, orientation, etc.) to depart, in at least one embodiment, from the exact manner or condition described with respect to an exemplary embodiment. Thus, the use of such terms as 'may', 'relatively', and others dispels rigid interpretive adherence to the described embodiments alone, implying extension of the scope of the invention to numerous additionally contemplated alternative forms.

Terms describing orientation (e.g., upwardly, horizontally, etc.) are typically, but not exclusively, used herein for descriptive clarity with regard to one or more clarifying conditions (e.g., during normal use, etc.). However, if not otherwise stated, a described orientation is generally referenced to one or more of the drawing figures, with the top edge of a referenced drawing sheet being arbitrarily designated 'up' or 'top' for descriptive simplicity alone.

Referring now to FIG. 1, an exemplary embodiment of an ink delivery apparatus (herein 'ink cartridge', or simply 'cartridge') 100 includes a housing 1 comprising one or more peripheral walls 2*a*/2*b*. The one or more peripheral walls 2*a*/2*b* are coupled with and/or disposed between one or more facing walls 3 to form an outer boundary structure defining a chamber 4 (herein 'ink chamber 4', 'fluid chamber 4', or simply 'chamber 4', etc.) therein. Each peripheral wall 2*a*/2*b* and facing wall 3 is described herein as having an inner side proximate the chamber 4, as well as having an opposing outer side generally proximate an exterior environment.

In at least one alternative embodiment, the one or more peripheral walls 2*a*/2*b* comprise an inner peripheral wall arrangement, and an outer peripheral wall arrangement (2*c* in FIG. 1), as described further herein, closely surrounds the inner wall arrangement. Thus, the inner and outer peripheral walls form a 'double peripheral wall arrangement' surrounding at least a portion of the chamber 4. Thus, any structures described herein as extending through a peripheral wall 2*a*/2*b*, or originating, terminating, or being disposed at or proximate to a peripheral wall 2*a*/2*b*, will in at least one embodiment, similarly relate structurally to either or both of an inner peripheral wall arrangement 2*a*/2*b* and an outer peripheral wall arrangement 2*c* (e.g., extending through both the inner and outer peripheral wall arrangements).

A cartridge 100 may further include one or more internal structures configured as partitions 5 disposed mainly within the walls of the outer boundary structure and within chamber 4. Such partitions 5 may further substantially subdivide the chamber 4 into sub-chambers 6/7 and/or passages, as will be described in greater detail below. Such sub-chambers may be described as 'substantially' subdivided inasmuch as they remain in fluid communication via fluid passages therebetween in at one or more embodiments.

Ink cartridge housing forms (e.g., shapes, sizes, and configurations) vary substantially, generally providing for compatible engagement with the varying structural and other parameters of each OEM's printing device ('printer'). Printers can be small enough for hand-portability (e.g., a label printer), or large enough to substantially fill a large room (e.g., a printer suitable for large-scale newspaper publishing), and anywhere in between. Therefore, contemplated embodiments of a housing 1 described herein can take any alternative form that is compatible with existing and/or reasonably contemplated printers configured to utilize an ink cartridge, and the embodiments are not limited to those exemplary embodiments depicted in the provided drawing figures. For example, a printer cartridge may have four peripheral walls and a facing wall, wherein each wall is joined with one or more adjacent walls by curving corner junctions. Therefore, the entire five-sided structure may be described as a unitary boundary structure comprising a single, continuous outer wall.

Alternatively, a printer cartridge could be configured as a cylinder with at least one enclosed end. However, as contemplated herein, such alternative housing configurations are considered to comprise one or more peripheral walls 2*a*/2*b* and one or more facing walls 3. Although certain features are described herein as being located or positioned at, or otherwise associated with one or more 'peripheral' walls, the embodiments are not so limited. In at least one embodiment, a structure so described may be located at a wall other than a 'peripheral' wall, such as at a facing wall.

The embodiments contemplate extended exposure of numerous portions and surfaces of an ink cartridge 100 to various materials (e.g., pigments, binders, solvents, carriers, etc.) comprising inks usable with printing devices. Therefore, such portions and surfaces for which ink exposure is expected generally comprise materials that do not degrade from such exposure. For example, materials can include polypropylene, ABS, polycarbonate or other polymers, plastics, or similar materials, as would be understood in the art to be suitable for use with the materials comprising one or more printing inks. Therefore, the materials deemed to be 'suitable' according to the contemplated embodiments generally include those exhibiting resistance to degradation from exposure to fluids and/or other materials contemplated for use with a printing device.

Cartridge 100 typically also includes one or more retaining structures 20 (e.g., a bolt, latch, etc.) presented outwardly from housing 1, and configured to detachably engage a corresponding (e.g., reciprocal) structural feature disposed at or proximate a cartridge receiving portion of a printer. Retaining structure 20 can be integrally formed with and/or at an outer surface of the cartridge 100, or can be detachably coupled therewith. Retaining structure 20 can further be unitary in design, or can include an arrangement of plural components and/or structural features.

For example, the novel and exemplary retaining structure 20 in FIG. 1 includes an integrally formed receiver 21 configured to receive and retain a latching member 22, and to guide the latching member 22 along a relatively linear translation path. A spring member 24 (e.g., a coil spring, a compressible, resilient material, etc.) disposed within the receiver 21 between the latching member 22 and a peripheral wall 2 of the housing 1 normally maintains the latching member 22 in position for latching engagement with a corresponding structural feature of a printer. The latching member 22 further includes a tab 23 extending outwardly from the retaining structure 20. In response to a dislocating force applied by a user to tab 23, latching member 22 dislocates (e.g., translates, slides, dislodges, etc.) relatively linearly relative to the receiver 21 and/or along a generally long axis of either or both of the latching member 22 and the receiver 21. In response to such dislocation of the latching member 22, spring member 24 is compressed, and latching member 22 disengages from the corresponding structural feature of a printer.

The latching member 22 further and/or alternatively, in an embodiment, includes an inclined surface 25 configured to contact a corresponding structure of the printer during engagement of the cartridge with the printer. In response to an engagement force applied to the cartridge by the user, the inclined surface 25 is forced against a corresponding printer structure, causing the latching member 22 to dislocate linearly and compress the spring member 24. Once the cartridge arrives at a position relative to the printer corresponding to engagement during normal use, the latching member 22 achieves clearance relative to the corresponding printer structure, and the spring member 24 is able to decompress. The latching member 22 responsively translates in an opposite direction (e.g., corresponding to decompression of the spring member 24) and engages with the printer.

One or both of the latching member 22 and the spring member 24 are manually detachable from the cartridge. In an embodiment, one or both of the latching member and the receiver are configured with one or more resilient retaining surface features (e.g., projection, recess, etc.)—collectively, and for described convenience alone, called 'resilient retaining features' herein. The resilient retaining features are configured to provide a retaining engagement between the latching member 22 and the receiver 21, for example, during normal use. However, upon application of a sufficient detaching force applied by a user, the resilient retaining features yield, allowing the latching member 22 and/or spring member 24 to be detached from the cartridge. Reattachment generally involves reversing the detachment process. Alternatively, the latching member 22 may be attached and/detached via any of a wide range of mechanisms, methods, and principles (e.g., friction, interference, twist-lock, retaining pin, etc.) as would be recognized by one having skill in the art in view of this description.

Of course, alternative retaining structures 20 are contemplated herein. For example, a retaining structure can take any form already present in printer cartridges available on the market, according to at least one alternative embodiment. Likewise, the individual structures and/or arrangements of the described components of the exemplary retaining structure 20 of FIG. 1 can also vary without departing from the spirit and scope of the invention.

As depicted in FIG. 1, cartridge 100 further includes a fluid dispensing port 30 (herein 'ink dispensing port 30' or simply 'dispensing port 30') extending through a peripheral wall of the housing and providing fluid communication between the inside and the outside of the cartridge during use. Generally, with regard to the ink dispensing port 30, the fluid is a liquid ink, and will also be interchangeably referred to herein as 'ink', 'printer ink', and 'inkjet ink', for example. Further, fluid communication through the dispensing port 30 is typically unidirectional and outward during normal use, and should be considered as such throughout this description unless specifically described otherwise.

Figure 2:
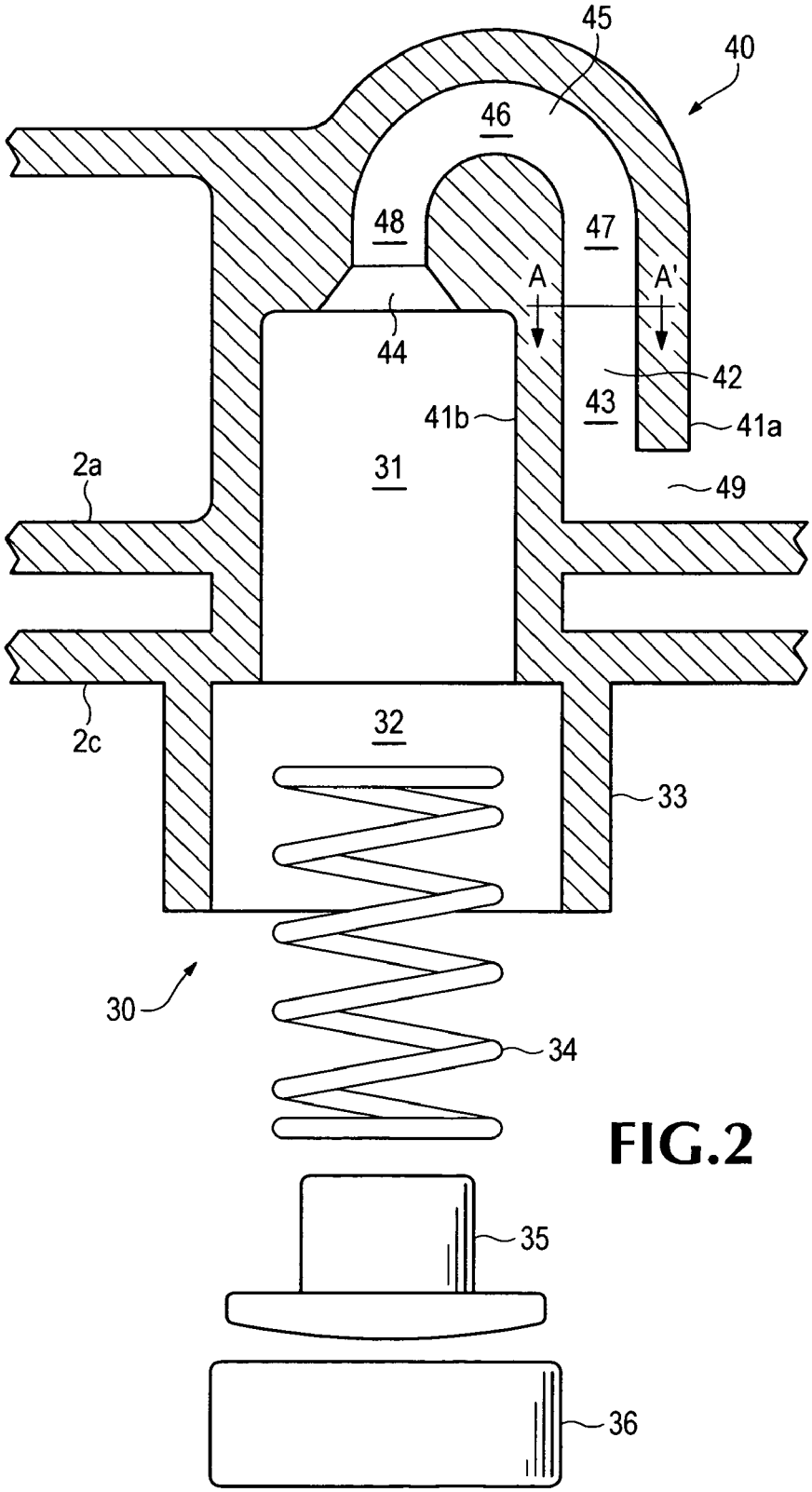
FIG. 2 depicts in detailed cross-sectional view the siphon structure and fluid dispensing port of the ink delivery apparatus of FIG. 1, according to a preferred but not exclusive embodiment of the invention.

The structural detail of an exemplary dispensing port 30, according to at least one embodiment, is depicted in FIG. 2. A typically but not exclusively cylindrical ink duct 31 extends through peripheral wall 2*a*, and as shown may also extend somewhat into the interior of the cartridge 100, or somewhat beyond its exterior. When extending beyond peripheral wall 2*a* in either direction, portions of ink duct 31 may be defined by an integrally formed extension of housing 1 and/or an attached duct-defining structure. The ink duct 31 is conveniently described herein as typically having an inflow end located and configured so as to receive ink from a siphon structure (or from a portion of a siphon structure) and an outflow end located and configured to convey ink externally from the cartridge.

Located at or near the outflow end of the ink duct 31 is typically, but not exclusively, an ink flow control chamber 32 (herein 'valve chamber') having a somewhat larger internal transverse cross-sectional dimension (e.g., diameter, etc.) than the ink duct 31. The valve chamber 32 may lie entirely within the outer boundary of the cartridge 100, or as shown in FIG. 2, can extend outwardly therefrom.

In an embodiment, an arrangement of one or more valve components is typically retained wholly or at least partially within the valve chamber 32. The valve components, whether individually and/or plurally and in concert, act to control ink flow from the dispensing port 30. Generally but not exclusively, these components comprise a sealing member 36 (e.g., an O-ring, membrane ring, etc.), a plugging member 35 (e.g., a stopper, valve flap, ball bearing, etc.), and a tensioning member 34 (e.g., a spring, a resilient compressible and/or deflecting material, etc.), as shown in the embodiment of FIG. 2. While typically comprising individual components, these valve components may alternatively be combined with one another, thus integrating multiple functions into a fewer number of components. Alternatively, one or more of the functions may be met by a feature designed into the structure of the valve chamber 32 itself, thus obviating or reducing the need for one or more of the individual valve components, or beneficially impacting the ink flow control performance of the dispensing port 30.

Of course, the various ink dispensing ports of ink cartridges compatible with different OEM's printer devices can vary widely in structure. For example, in an embodiment, an ink dispensing port may comprise nothing more structurally complex than an opening formed in a wall (e.g., peripheral wall, facing wall, etc.) of the cartridge. A temporary cover may be provided to prevent ink from escaping from the hole prior to use, the cover being relatively easily removed by the user at the time the cartridge is coupled with a printer for use. In another embodiment, a rather more complex structure may be provided including one or more of a force-responsive valve, an electrically-actuated valve, a thermally-responsive valve, or an pneumatically-actuated valve, for example.

Also present in the exemplary embodiment depicted in FIG. 1 is a refill port 70 disposed at a wall 2*b* of the cartridge housing 1, enabling delivery of a fluid (e.g., ink) into the chamber 4. The refill port typically includes an opening 72 formed through the wall 2*b*, the size and/or shape of which can vary. In an exemplary embodiment, the shape is round, with a diameter found within a range of approximately one to ten millimeters (1-10 mms.), although larger and smaller openings are likewise within the contemplated scope.

A refill port 70 also typically includes a sealing member 74 configured, for example, as a plug, stopper, or similar device (referred to as a 'plug' herein for descriptive simplicity). A plug 74 enables a user to selectively open and/or close (seal) a refill port 70 as needed to replenish a volume of ink in the cartridge 100.

A plug 74 typically comprises a material, for example silicone rubber, that resists degradation due to contact with ink materials, as discussed above. As a friction fit and/or compression fit engagement between a plug 74 and the inner edges of an opening 72 provides a beneficial sealing arrangement, the plug 74 may commonly comprise a relatively soft, compressible material, although the embodiments are not so limited.

Alternatively, a plug 74 may engage at and seal an opening 72 of a refill port 70 by any of numerous methods. The plug 74 may engage with either or both of internal and external threads of the refill port opening to enable 'screwing' the plug 74 onto or into a sealing condition. A portion of the housing surrounding the opening may be raised into a rim, or flange, or lip, with external threads provided internally and/or externally thereat, or a similar structure may be coupled with the housing to provide a rim, or flange, or similar feature.

A plug may be reusable, or may be configured for disposal (or displacement) and replacement after a single use. For example, a plug (e.g., a small metal ball, etc.) may be configured to be pushed into the chamber 4 to enable refilling through the opening 72, and is then subsequently replaced by another similar or different plug after refilling is complete. Further, to enable plug removal, a plug 74 may include a tab 76 (e.g., 'tag') or other structure provided at the exterior of the housing 1, so configured and arranged as to enable a user to gain purchase on the plug, manually or through the use of a tool, for decoupling the plug 74 from the opening 72.

The embodiments of a refill port and its associated structures provided herein are exemplary only, and do not encompass the full range of envisioned alternative and/or equivalent embodiments. For example, a plug 74 may be as simple as a plastic membrane secured with an adhesive across the outside of the opening 72 to provide a leak resistant barrier.

Generally, except as expressly stated herein, the scope of the inventive embodiments contemplated herein is not considered to be limited to any particular ink dispensing port structure or ink refill port, and in particular, is not limited to the described embodiments alone.

Several particularly novel features of the invention will now be described in detail according to one or more embodiments.

Ink Siphon

The novel siphon structures described according to the exemplary embodiments herein provide substantial benefits over the earlier discussed prior art, while also providing a consistent supply of ink to the ink dispense port.

Referring once again to FIG. 2, a siphon structure generally comprises one or more partitions 41*a*/41*b* defining a curved conduit 42, or 'ink conduit 42', (e.g., tube, pipe, channel, etc.) extending from the chamber 4 to the dispensing port 30. In particular, the curved conduit 42 includes a fluid ingress portion presented to the chamber and a fluid egress portion presented to the dispensing port, and thus the curved conduit 42 is configured suitably to provide fluid communication from the chamber to the fluid dispense port. For convenience herein, an end of the curved conduit 42 exposed to the chamber 4 is termed the intake end 43, and an opposite end exposed to the dispense port 30 is termed the output end 44.

One or more conduit defining partitions, such as 41*a* and 41*b* of FIG. 2, typically extend fully from an inner surface of one facing wall 3 to an inner surface of an opposing facing wall. In an embodiment thusly formed, an ink conduit 42 is fully enclosed on all sides, and typically open only at its intake and output ends. Alternatively, the curved conduit 42 can be formed of virtually any structure (e.g. tube, pipe, etc.) configured to form a continuous, curved fluid conduit providing a fluid flow path having the basic fluid conveying properties of a siphon as discussed below.

One having skill in the art will recognize that portions of the curved conduit depicted in FIG. 2, and as also described relative to FIG. 1, will generally possess a quadrilateral (e.g., square or rectangular) transverse cross-section, along line A-A' for example. However, virtually any transverse cross-sectional shape is possible according to alternative embodiments (e.g., a tube having a round cross-sectional shape, etc.), and the cross-sectional shape and/or dimensions can also vary at different portions of the ink conduit 42.

By 'curved', it is meant that the ink conduit 42 is not linear, and more particularly, that at least a portion of the ink conduit 42 forms a bend 45 through which the direction of flow of a fluid is altered from a generally upward direction to a generally downward direction (e.g., when positioned for normal use). For example, FIG. 2 depicts an exemplary (although not exclusive) embodiment wherein the flow direction of a fluid is altered approximately one-hundred and eighty degrees (180°) at the output end 44 relative to the generally upward flow direction at the intake end 43.

During normal use, the bend 45 is generally disposed intermediate between, and elevated relative to, each of the intake end 43 and the output end 44 of the ink conduit 42. Conceptually, and for convenience herein, the portion of the ink conduit 42 disposed between the apex 46 of the bend 45 and the intake end 43 is termed the intake leg 47. Likewise, the portion of the ink conduit 42 disposed between the apex 46 and the output end 44 is termed the output leg 48. Typically, but not exclusively, portions of the dispense port 30, such as ink duct 31 and/or ink flow control chamber 32, comprise a portion of the output leg 48.

As will be readily understood by those having skill in the art, the output leg 48 is relatively longer than the intake leg 47, as will be discussed below with regard to the functional principles involved.

Typically, but not exclusively, an inlet gap 49 is provided between partition 41*a* and an inner surface of the peripheral wall 2*a*. The gap 49 provides an inlet for ink residing in the chamber 4 to enter the intake end 43 of the ink conduit 42. Alternatively, the partition 41*a* may terminate at and form a union with the peripheral wall 2*a*. However, in such embodiments, one or more openings are generally provided through the partition 41*a* at or near its intersection with the peripheral wall 2*a*. Generally, discussion herein with regard to the structural and functional aspects of the inlet gap 49 in a exemplary embodiment also applies to the one or more openings provided in the described alternative embodiments. For convenience alone, all such gaps or other openings as described in, or reasonably understood from, the description in this paragraph will be collectively termed 'inlet gap 49', 'inlet 49' or simply 'gap 49', hereinafter.

The dimensions of a gap 49, or the cumulative dimensions of plural gaps or other openings forming inlet 49, can vary in alternative embodiments. For example, a relatively larger opening may be useful and tolerated when a more viscous fluid will be used, while a smaller opening may be beneficially used with a less viscous fluid, although fluid viscosity is only one factor for determining a suitable opening size in an embodiment.

A siphon is typically used to move a liquid from an origin at a given/first level, to a destination at a relatively lower level, such as through a pipe, hose, tube, or another defined conduit. As will be recognized by those having skill in the art, a siphon generally relies on the cooperating principles of atmospheric pressure and gravity. An upper end of the pipe, for example, is placed into a body of liquid, and an opposite end of the pipe is placed at a lower level relative to the upper end. Atmospheric pressure applied to the body of liquid forces a column of liquid up the intake leg of the pipe, while a relatively longer column of liquid in the output leg responds to gravity, pulling the generally continuous column of liquid through the pipe, and continuing to draw additional liquid into the intake leg from the body of liquid. Thus, a substantially continuous flow of liquid is achieved through the siphon.

However, if the level of liquid in the body of liquid falls below the intake end of the pipe, the siphon effect may be interrupted, and continuous flow of liquid through the siphon may cease.

In operation, the novel printer cartridge siphon structure 40 described and depicted herein employs similar operating principles to convey ink from the chamber 4 to and through the dispensing port 30, as needed during printing. Generally, the siphon structure 40 is disposed mainly within a cartridge 100 such that the inlet 49 is orientated at or near the lowest point within the chamber 4 during use. Therefore, the inlet 49 will remain covered by whatever quantity of ink is present in the chamber 4 until all or nearly all ink is emptied from the cartridge 100.

Because the siphon structure 40 does not rely upon a sponge or other wicking structure to convey ink throughout the chamber to the ink dispense port 30, nearly the entire chamber 4 can be filled with ink. The resulting increased ink capacity likewise increases the useful lifetime of the disclosed embodiments relative to cartridges that utilize sponges.

At least one other 'spongeless' ink cartridge is present in the art, as described in U.S. Pat. No. 7,328,986, entitled Inkjet Printer Ink Cartridge ('986). Although '986 describes that a siphon device is configured within the ink cartridge, one having ordinary skill in the art will readily recognize that the so-called 'siphon device' '986, later described therein as an 'equilibration tube', is not equivalent to the herein described siphon structure in any of purpose, form or function. Those having skill will recognize that in purpose and function, the equilibration tube in '986 is an air vent, to obviate accumulation of a relatively negative air pressure within the cartridge as ink is dispensed therefrom. However, the equilibration tube plays no role in conveying ink from the chamber to the dispense port, does not operate based on a siphon principle as described above, and is not structurally configured for that purpose. Therefore, those having skill will readily recognize that the cartridge and siphon structure described according to the embodiments herein are wholly distinct, both structurally and functionally, from the cartridge and equilibration tube of '986.

Figure 3:
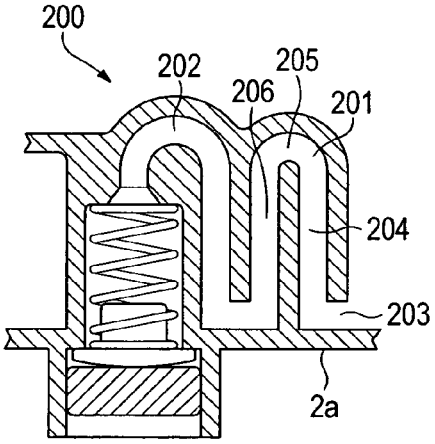
FIG. 3 depicts in detailed cross-sectional view a siphon structure of an ink delivery apparatus, wherein the siphon structure includes plural sequential fluid flow passages according to a preferred but not exclusive embodiment of the invention.

The embodiment depicted in FIG. 2 as having a single ink conduit 42 can conveniently be referred to as a 'single-siphon' embodiment. However, the embodiments are not so limited. Alternatively, as shown in FIG. 3, a cartridge according to an alternative embodiment 200 of a siphon structure within the broad scope of the current invention can likewise include plural (two or more) contiguous, curved ink flow passages (e.g., conduits). For example, a second curved conduit 201 possesses a structural arrangement very similar to that of the curved conduit 42 of FIG. 2, including an inlet gap 203, an intake leg 204, a bend 205, and an output leg 206. However, in the case of FIG. 3, the curved conduit 201 is sequentially (e.g., serially) contiguous with ink conduit 42, forming a single extended conduit with plural, similarly-arching portions along its length.

The plural curved portions, which may also be referred to as a 'multiple contiguous siphons system', increase the flow resistance to ink flowing through the siphon structure. Increased flow resistance helps to prevent ink leakage in ink cartridge embodiments that lack a fully sealing dispense port (e.g., cartridges that retain ink by a sponge and/or fiber arrangement), for example.

Alternatively and/or additionally, increased ink flow resistance can also be achieved in an embodiment by increasing the 'height' of one or more siphon curved portions (e.g., increasing the length of the intake leg 47 and the output leg 206), in embodiments having either single or multiple siphon curved portions. Of course, either or both of the number and/or height of the one or more curved portions of a siphon may be limited in a contemplated embodiment (e.g., by the available space within the chamber), as would be understood by one having skill in the art in view of the descriptions and figures provided herein.

While FIGS. 2 and 3 depict siphon structures with relatively arching and rounded bends 45/205, the embodiments are not so limited. In at least one alternative embodiment, rather than a single arching bend, the intake and output legs of a siphon structure can instead be separated from one another by plural bends having a relatively linear transitional conduit portion therebetween. For example, a transitional conduit portion can be a relatively linear transverse conduit wherein ink flow is orientated approximately ninety degrees relative to ink flow in either or both of the intake leg and the output leg. Thus, while in use, the intake and output legs may each be disposed relatively vertically within the cartridge, while the transitional conduit portion may be disposed relatively horizontally therebetween.

Fluid Input Port

According to the exemplary embodiment depicted in FIG. 1, an ink delivery cartridge 100 further includes an internally partitioned fluid input port 50 (herein, 'input port 50') by which a fluid can be introduced into a chamber 4 of the cartridge 100. According to alternative embodiments, a fluid introducible into a cartridge via the input port 50 can be either a gas (e.g., air), wherein the input port 50 provides ventilation (e.g., as a pressure equalizing vent), or the fluid can be a liquid (e.g., ink), wherein the input port 50 acts as an ink supply port in a continuous ink supply system (CISS), for example.

Figure 4A:
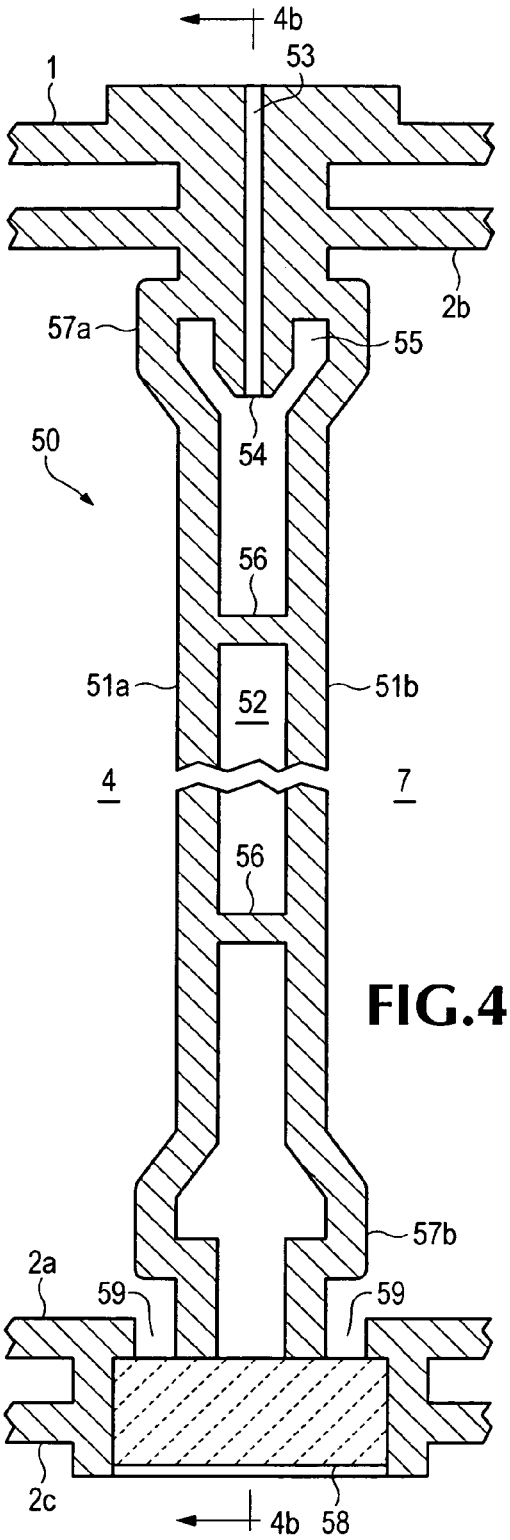
FIGS. 4*a* and 4*b* depict cross-sectional views through respective perpendicular longitudinal planes of an internally partitioned fluid input port of an ink delivery apparatus according to a preferred but not exclusive embodiment of the invention.
Figure 4B:
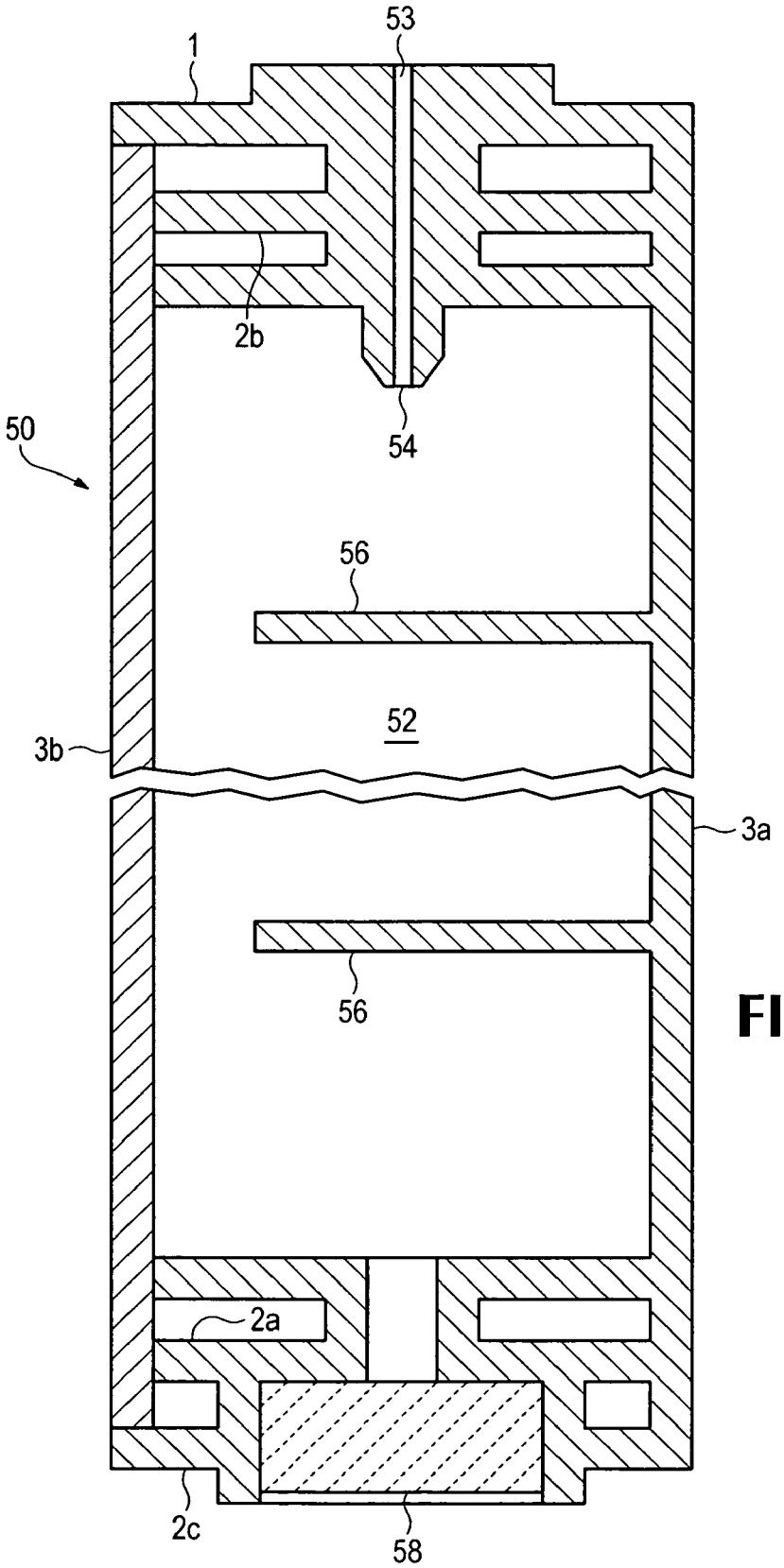

Referring now to FIGS. 4*a* and 4*b*, an exemplary internally partitioned fluid input port 50 is disposed at and extends through a second peripheral wall 2*b* of the housing (and through an outer peripheral wall 2*c* when present). The input port 50 is described herein as being 'internally partitioned' because one or more partitions 51*a*/51*b* (as best shown in FIG. 4*a*) thereof define a substantially unidirectional fluid passage 52 within and extending at least partially through the chamber. The fluid passage 52 is described as being 'substantially unidirectional' because a fluid is generally intended to flow in only one direction (e.g., from the outside to the inside of the cartridge) through the passage during normal use. One or more structural features included in an exemplary embodiments (described further below), are intended to discourage counter-directional fluid flow (e.g., from the inside to the outside of the cartridge).

The exemplary input port 50 includes a fluid input duct 53 configured to provide fluid communication from a source external to the cartridge 100, through the second peripheral wall 2*b* (and when present, through outer peripheral wall 2*c*), and into the unidirectional fluid passage 52. Generally, a cross-sectional area of the fluid input duct 53, at its junction with the unidirectional fluid passage 52 is substantially smaller than a corresponding cross-sectional area of the unidirectional fluid passage 52. For example, when used according to an exemplary embodiment of either a conventional and/or refillable cartridge, the fluid input aperture 53 has a cross-sectional area corresponding to an internal diameter of approximately one millimeter (1 mm). By contrast, the generally rectangular cross-sectional area of the unidirectional fluid passage 52 in the same embodiment has a cross-sectional area of approximately ten square millimeters (10 $mm^2$).

However, each of the relative internal diameters and cross-sectional areas described above can vary according to alternative embodiments, and are not limited to the dimensions described according to the exemplary embodiment. For example, a CISS embodiment of a cartridge can instead be formed with a fluid input duct 53 having an internal diameter of approximately four millimeters (4 mms.), for example, to facilitate relatively less restricted flow of ink into the unidirectional flow passage 52. Further, the cross-sectional shapes of the fluid input duct 53 and the unidirectional fluid passage 52 can vary widely in alternative embodiments (e.g., polygonal, circular, etc.).

Likewise, in one or more embodiments, the unidirectional fluid passage 52 can be formed with an enlarged portion 55 that forms a small fluid reservoir adjacent to an inner end of the fluid input duct 53, as best shown in FIG. 4*a*.

Adjacent to its junction with the unidirectional fluid passage 52, the fluid input duct 53 passes through and exits from a backflow restriction structure 54, depicted substantially as a conically or frusto-conically shaped projection (e.g., nipple), for example, according to the exemplary embodiment of FIG. 4. Typically but not exclusively, an opening from the fluid input duct 53 into the unidirectional fluid passage 52 is located approximately midway between the respective facing walls 3*a*/3*b*, as best shown in FIG. 4*b*. As a natural consequence, at least the position and shape of the backflow restriction structure 54, as well as the relatively small size of the fluid input duct 53, will tend to restrict a liquid from entering the fluid input duct 53 from the unidirectional fluid passage 52 during normal use.

With regard to FIG. 4*b*, facing wall 3*a* is depicted as a relatively thin and flexible sheet (as shown also in FIG. 1 at 8), inasmuch as facing wall 3*a* may be a flexible sheet in at least one embodiment. However, one having ordinary skill will recognize, in view of this description, that facing wall 3*a* may also be configured in at least another embodiment as a relatively thicker and relatively rigid wall in much the same way as facing wall 3*b*. Therefore, the contemplated embodiments include either of a facing wall 3*a* configured as a thin, flexible sheet or as a relatively thicker and more rigid wall.

Further helping to obstruct and restrict counter-directional ink flow are one or more bulkhead partitions 56 (herein, 'bulkheads') disposed within the unidirectional fluid passage 52 in one or more but not all embodiments. Each bulkhead 56 is configured to extend partially across the unidirectional fluid passage 52, as best seen in FIGS. 4*a*-4*b*, narrowing the fluid passage 52 and impeding fluid flow therethrough anywhere in a range from marginally (e.g., slightly greater than zero percent) to substantially (e.g., slightly less than one hundred percent). One or more open passages past and/or through a bulkhead 56 can possess nearly any shape, and can be located proximate to or through nearly any portion of the bulkhead 56.

Generally, although not exclusively, an internally partitioned fluid input port 50 extends from a first end 57*a* proximate the second peripheral wall 2*b* to a second end 57*b* proximate the first peripheral wall 2*a*.

While FIGS. 1 and 4 depict a fluid input port 50 that is generally linear along all or some portion of its length, the fluid input port 50 can alternatively possess a non-linear configuration, including one or more bends and/or curves along its length. One having skill in the art will also recognize that one or more structural dimensions of the partitions 51*a*/51*b* and/or the unidirectional fluid passage 52 (e.g., passage width, partition thickness, etc.) can vary in at least one portion of the fluid input port 50 relative to at least another portion thereof. Thus, the scope of the invention is not limited to those exemplary embodiments described herein or depicted in the figures, but includes those that would reasonably be recognized by one having skill in the art as being equivalent to those expressly, impliedly, and/or inherently disclosed herein.

According to an alternative embodiment, a fluid input port 50 extends inwardly from the second peripheral wall 2*b*, but does not extend fully to the first peripheral wall 2*a*. Instead, it extends to different peripheral wall, or to a facing wall, or it terminates within the chamber without extending fully to another peripheral or facing wall. Likewise, as the scope of the invention includes cartridge configurations that may not be considered to include plural peripheral walls, it should be understood that the embodiments encompass a fluid input port 50 that extends inwardly from nearly any exterior wall (or any portion of a unitary exterior wall) of a cartridge 100.

Typically, although not exclusively, embodiments of a fluid input port 50 include a filtering medium 58 (e.g., material, structure, or some combination of either or both) disposed proximate the second end 57*b*. The filtering medium 58 can be disposed within a recess formed into the first peripheral wall 2*a*, or at an inner surface of the first peripheral wall 2*a*, or even within the unidirectional fluid passage 52. In an embodiment having dual peripheral walls with a gap disposed therebetween, as shown in FIG. 1, a filtering medium 58 can be located in a recess disposed between the inner and outer peripheral walls (e.g., between 2*a* and 2*c*), with a filtered fluid re-entering the chamber through one or more inlets 59 provided, for example, near and/or outside the periphery of the filtering means. Generally, however, the filtering medium 58 is located and configured so that a fluid (whether a gas, a liquid, or both) must pass through the filtering medium 58 before entering from the fluid input port 50 into the chamber 4. Therefore, filtered fluids are generally kept separate from as-yet unfiltered fluids.

A filtering medium 58 can include any one or more of a pressed or woven fiber structure, a mechanical and/or structural arrangement of the first peripheral wall 2*a* (and/or an outer peripheral wall 2*c*), a porous and/or selectively permeable membrane, a particle trap, a screen, a textile, and/or any of numerous other materials, structures, and/or arrangements as are known in the art. A filtering medium 58 is typically utilized at least on the basis of its selectivity, including its ability to deter, at a suitable level of efficiency, debris larger than a predetermined size from entering the chamber 4 from the fluid input port 50.

Filtering medium may be characterized according to their ability (e.g., efficiency) to prevent passage of particles having a one or more dimensions at or exceeding a specified size. For purposes of descriptive simplicity and clarity herein, reference to debris of a 'predetermined size' herein generally refers to one or more particle size(s) to which a filtering medium typically resists passage at a particular level of efficiency.

For example, a particular filter medium may prevent passage of five micron (5μ) and larger particles with ninety-nine percent (99%) efficiency (e.g., only approximately one out of every one hundred 5μ particles and larger typically passes through the filter medium), while the same filter medium may prevent passage of one micron (1μ) particles with only sixty-five percent (65%) efficiency. For the sake of convenience, a filter may simply be referred to based on the smallest size of particles at which the filter prevents passage at or above a predetermined threshold efficiency. For example, the above described filter medium may be described as a 'five micron filter' at a threshold efficiency of 99%.

As discussed, while the fluid input duct 53 has an inner width (e.g., diameter) of approximately one millimeter (1 mm.), for example, in conventional and refillable cartridge embodiments, the inner width will generally be wider in CISS embodiments. However, inasmuch as the main cartridge housing 1 is easily formed by a molding process, for example, molds configured to form any of a CISS, conventional or refillable cartridge according to the invented embodiments can be easily and quickly modified to form any other of a CISS, conventional or refillable cartridge according to the invented embodiments. Such change is accomplished by, for example, simply changing a molding member (e.g., pin, rod, etc.) that extends inwardly into the mold cavity, and which forms the fluid input duct 53 once the molding member is withdrawn following molding. Thus, embodiments of the invented ink cartridges enable simple and rapid conversion, in production, between the three indicated cartridge types.

Alternatively, a cartridge may be formed with a four millimeter fluid input duct, for example, thus rendering it easily usable for CISS purposes. However, if desired, a plug having a one millimeter (1 mm.) fluid input duct passing therethrough can be securely yet removably inserted into the four millimeter (4 mm.) hole. By this and related embodiments, a cartridge that is manufactured for CISS uses can be converted to one usable as either or both of a conventional and/or refillable cartridge, and if desired, converted back for CISS use. Such uniformity of design and ease of conversion for one or more desired uses further reduces waste and saves resources.

As will be understood in view of the above examples and descriptions, the invention contemplates a combination mold (e.g., injection mold, etc.) configured and/or configurable to produce any of three ink delivery apparatuses (e.g. cartridges). They respectively are: a conventional ink cartridge, a refillable ink cartridge, and a continuous ink supply system (CISS) ink cartridge for use with one or more bulk ink bottles and ink lines providing fluid communication between the CISS cartridge and ink bottle(s). Thus, the invention provides an easily refillable ink delivery system to reduce both the cost to the consumer and the environmental impact.

Resettable Chipset

As mentioned, printer cartridges sometimes include an electronic device designed to track (e.g., count) electronic signals corresponding to ink dispense events. At each ink dispense event, the cartridge generally dispenses a relatively uniform quantity of ink (e.g., approximately three to four pico-liters). Therefore, tracking an ink dispense signal count relative to a typical cartridge ink capacity provides an approximate indication of when a cartridge is approaching a 'low ink' and/or 'empty' condition, prior to complete depletion of all ink in the cartridge.

Figure 5:
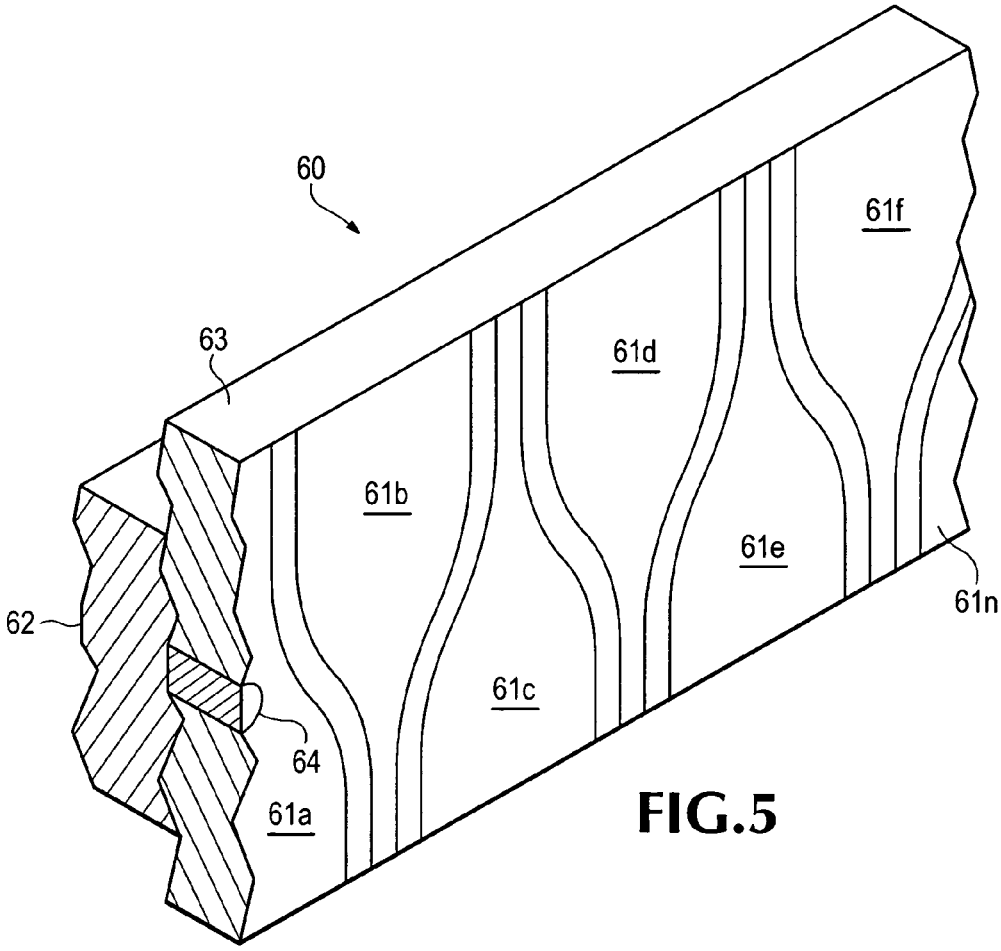
FIG. 5 depicts in cross-sectional view a resettable electronic device detachably coupled with an ink delivery apparatus according to a preferred but not exclusive embodiment of the invention.

Likewise, with reference to FIG. 1 and FIG. 5, embodiments of the invention disclosed herein include a resettable electronic device 60 generally having plural electrically-conductive contacts 61*a*-61*n* configured to conductively couple with and receive a signal from a printing device. For descriptive simplicity herein, embodiments of a resettable electronic device 60 are alternatively referred to as a 'chipset 60'.

Typically, although not exclusively, the chipset 60 will include one or more integrated circuit devices 62 (e.g., silicon chips) physically coupled at one side of a printed circuit board (PCB) 63. Typically, at least one of the integrated circuit devices 62 will have processing circuitry and capabilities, and for descriptive simplicity herein, is referred to as a processor 62. The PCB includes, disposed at a second opposing side thereof, one or more electrically conductive 'contact pads' 61*a*-61*n* (or simply 'contacts 61'), wherein 'n' designates a variable total number of plural contacts according to alternative embodiments.

The contacts 61 are coupled in electrical communication with the chipset by one or more via holes or so-called 'vias' 64 or other functionally similar structures configured to provide an electrically conductive pathway from a 'chip side' of the PCB to a typically opposing (e.g., converse) 'contact' side of the PCB. The contacts 61 are generally but not exclusively electrically isolated one from another at the surface of the PCB 63, and they are located so as to each engage in electrical communication with a corresponding electrical contact of a printer when properly installed for and during use therewith.

Typical prior art contact arrays comprise one or more rows and/or columns of generally square and/or rectangular contacts, with relatively large expanses of non-conductive material lying therebetween. However, in at least one novel embodiment, an array of contacts comprises plural contacts separated by relatively narrow non-conductive regions. In such embodiments, the contacts are arranged and defined to enable engagement with corresponding contacts of a printer device. However, the contacts of a resettable chipset, according to at least one embodiment, are not arranged in regular rows and/or columns. Rather, according to various embodiments, the contacts include either or both of asymmetrical and symmetrical grid-wise-orthogonal overlapping shaped electrically-conductive pads, whether overlapping column-wise or row-wise or both. Each such contact generally possesses a larger surface area than would a corresponding contact in an array of contacts conventionally arranged in rows and/or columns. One example of a novel contact array is depicted in FIG. 5. An embodiment also includes at least one contact which differs in either or both of shape, length and/or width from at least another contact within the same array.

A typical but non-exclusive embodiment further includes, within the one or more integrated circuit devices 62, memory circuitry configured to store data, such as one or both of an ink volume value (e.g., an incrementing dispense signal count) and one or more preset warning values (e.g., dispense signal count limits). By 'incrementing', it is meant that the memory circuitry is able to detect and track (e.g., 'count') ink dispense signals received from a printer as an accumulating total number of dispense signals increases relative to an original starting count (e.g., zero). The memory circuitry may be provided in the processor 62, or alternatively, in one or more discrete integrated circuit memory devices also similarly coupled with the PCB and/or in electrical communication with the processor 62. Alternatively, the memory circuitry that performs the counting function can be implemented as a discrete or integrated ring counter, loop counter, bucket brigade device, or the like.

The memory circuitry can be configured to include either or both of Read-Only memory (ROM) portions and Random Access Memory (RAM), and can included either or both of volatile memory (e.g., subject to data loss in the event of a power interruption) and non-volatile memory (e.g., 'Flash' memory). Alternative memory devices may likewise be used, as would be recognized by one skilled in the art in light of the description provided herein. In either case, for descriptive simplicity, such memory circuitry is alternatively referred to herein as 'memory', or 'memory chip'.

Additionally, a resettable chipset device generally includes a supporting structure 65 configured to retain the printed circuit board, as well as the processor 62 and/or memory, coupled therewith. The supporting structure 65 is further generally configured to detachably couple with one or more walls forming the housing 1 of an ink cartridge. For example, a wall of the housing, in an embodiment, includes a retaining structure 66 or arrangement of retaining structures configured to couple with and detachably retain a corresponding retaining feature 68 of the resettable chipset. Alternatively, in at least one embodiment, a resettable chipset is coupled with the cartridge either integrally, or in a manner that otherwise renders the chipset not easily detachable without permanently altering (e.g., damaging) a structural feature of the cartridge housing.

An arrangement of retaining features 66/68 for coupling the chipset supporting structure 65 with the ink cartridge housing, and/or for coupling the PCB with the chipset supporting structure, can include any one or more of magnetically attractive members, adhesives, reciprocal friction-fitting members, force-responsive deformable latching members, thermally-deformable members, twist-locking members, fasteners (e.g., screws, pins, etc.), or any others as would be understood by one having skill in the art. Alternatively, a portion of a cartridge housing can include a receptacle configured to receive and retain therein all or some portion of a resettable chipset device.

The chipset supporting structure 65 can be formed by any of numerous known manufacturing techniques (e.g., extrusion, injection molding, etc.), and may be of any material (e.g., plastic, polymer, metal, etc) that is suitably rigid to enable secure and durable coupling (yet also detachable in an embodiment) with the cartridge housing. The supporting structure 65 will also be suitably rigid to retain electrical contacts of the PCB in position relative to corresponding electrical contacts of a printer for electrically-conductive coupling during use.

When refilling the ink in an ink cartridge, it is beneficial to be able to reset a ink level-indicating value stored in chipset memory circuitry, to indicated the cartridge as being filled or nearly filled with ink. Resetting of the chip set can be accomplished manually using a separate device that electrically couples with one or more contacts of the chipset and in electrical communication with the one or more integrated circuit devices 62. For descriptive simplicity herein, a manually resettable chipset is referred to as a 'RAC' (resettable chipset). One example of a RAC is described in U.S. Pat. No. 7,192,109, entitled Environmental Protection Ink Cartridge Control ('109).

However, at least another embodiment of the invented ink cartridge includes an automatically resettable chipset that includes circuitry configured to reset a chipset automatically, without the use of a separate device, upon electrical decoupling of one or more of the contacts 61 from a printing device, for example. For descriptive simplicity herein, an automatically resettable chipset is referred to as an 'ARC'. One having ordinary skill in the art will recognize that '109 fails to describe or suggest an ARC.

Exemplary Resettable Ink Cartridge Logic Flow

Figure 6:
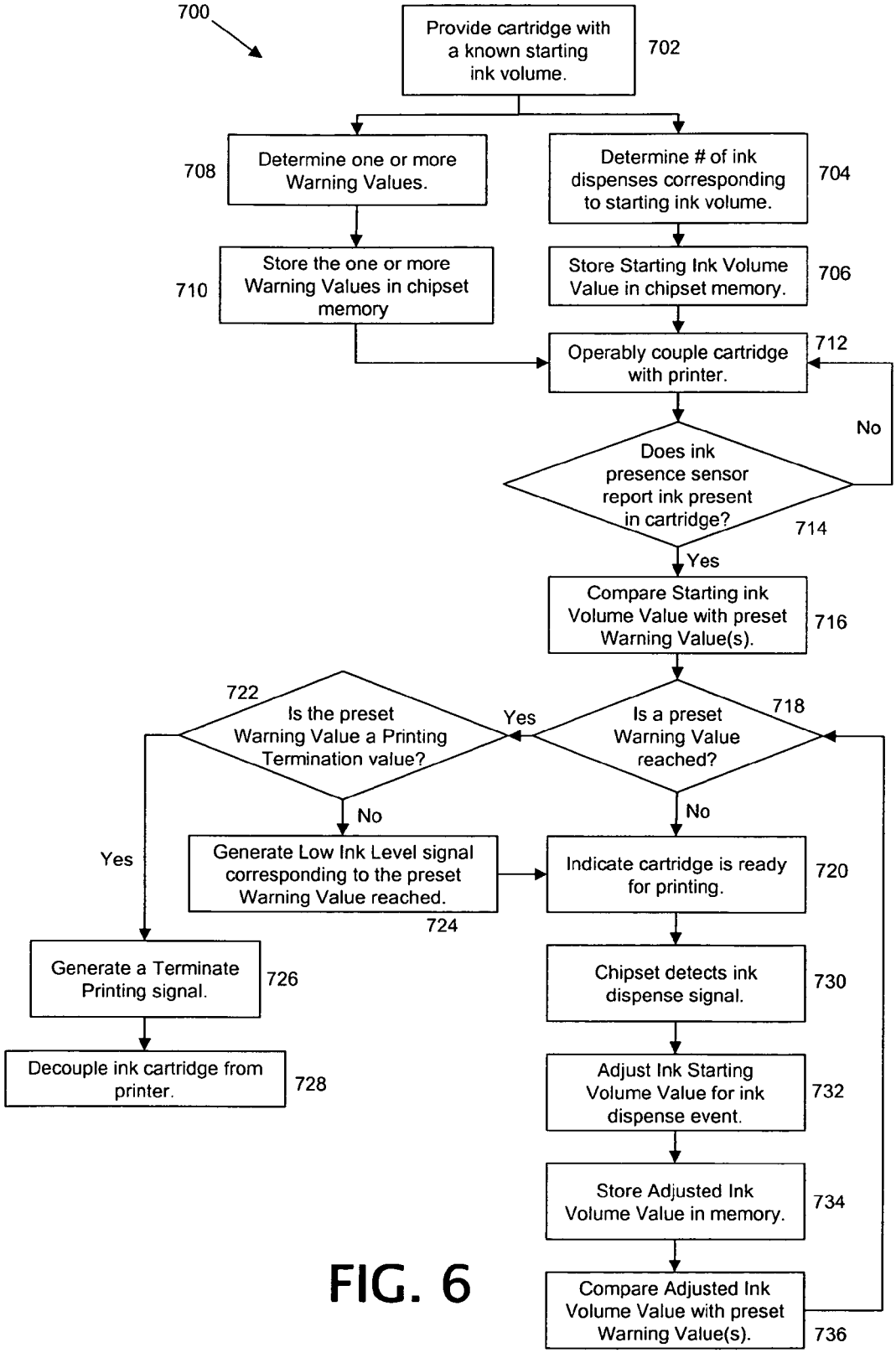
FIG. 6 depicts a block diagram of a logic flow related to cartridge ink level monitoring, according to a preferred but not exclusive embodiment of the invention.

For each of a RAC and an ARC, an exemplary logic flow 700 can be described according to the exemplary block diagram depicted in FIG. 6.

Referring first to FIG. 6, an ink cartridge having a known ink volume, referred to herein as a 'starting ink volume' or 'starting volume' for descriptive simplicity, is provided at 702. The starting volume may be a maximum capacity of the cartridge, a volume derived based on a weight of the cartridge, a known amount added to the cartridge by a user or third-party refiller or refilling service provider, a volume stated by a provider of the cartridge (e.g., a manufacturer), or an otherwise determined volume.

Based on the starting volume, a corresponding number of potential ink dispenses is determined at 704. One method for determining a number of potential ink dispenses involves dividing the starting volume by an approximate or known ink volume dispensed at each dispense event (e.g., in response to a dispense signal provided by a printing device). For example, approximately three to four pico-liters (3-4 pL.) of ink may be dispensed in response to each dispense signal from a printer. The total potential number of ink dispenses corresponding to a starting volume may be expressed as a range or as an integer representing a number of dispense events (e.g. dispense signals received from the printer by the chipset).

As discussed below, a primary (but not exclusive) reason for determining a number of potential ink dispenses is to enable determining one or more warning values corresponding to one or more cumulative numbers of dispense events during use. The one or more warning values may be 'predetermined' (e.g., determined prior to a use with an ink cartridge), and may be 'preset' (e.g., stored in memory of a chipset prior to use with an ink cartridge) according to an embodiment. The one or more warning values in turn represent one or more estimated ink volumes at which a user may be warned that an ink level in the cartridge is low.

Alternatively, rather than determining a warning value as a number of potential dispenses corresponding to a starting volume, a value may be selected which corresponds to and/or represents the approximate volume of ink dispensed in response to each dispense signal.

At 706, a starting ink volume value (e.g., 'starting value', 'default value', 'predetermined value', etc.) is stored (e.g., 'set') in memory circuitry of the chipset. The starting value typically corresponds to and/or represents the starting ink volume. For example, the number of potential ink dispenses determine at 704 can represent the starting ink volume. In this situation, an estimated remaining ink volume (e.g., 'then current ink volume') can be determined throughout use of an ink cartridge by decrementing the starting value at each ink dispense event. Alternatively, a starting value can be 'zero', and can be incremented at each ink dispense event to represent an estimated remaining ink volume throughout use.

One having ordinary skill in the art will recognize, however, that starting values other than 'zero' and/or the number of potential ink dispenses can be used, alternatively or additionally, without departing from the scope and intent of the contemplated embodiments. Likewise, at least one embodiment allows for a user to select, and a resettable chipset to perform, either or both of incrementing and decrementing an ink volume value.

Storing a starting value can be performed via a Graphical User Interface (GUI) provided at a display device coupled either integrally, directly or indirectly with an embodiment of the invented resettable electronic device. A starting value can also or instead be input by using, for example, a mouse, joystick, keyboard, touch-responsive display, numeric keypad, light—(e.g., laser) and/or sound—(e.g. voice) responsive data entry system, assistive data entry device (e.g., eye gaze tracker, air-puff input device, etc.), or any other input device or combination thereof currently known or reasonably contemplated in the art for electronic data entry.

In an embodiment, the starting value exists as a preset value or instruction residing in a memory circuit of a computing device and/or a printing device, and is communicated to and stored at the resettable chipset upon or after operative coupling of the chipset therewith. Alternatively, an ink volume value can be stored via another device or system configured to electrically couple with and exchange data and/or instructions with a memory chip of one or more embodiments of a resettable electronic device when the chipset is not coupled with a printer.

In a typical but not exclusive embodiment of an ARC chipset, a starting value is permanently stored as a default value (e.g., setting) at the chipset memory circuitry, and resetting of the starting value by the user is either or both of unnecessary and not enabled. Initial setting of the starting value may be performed by a chipset manufacturer, or by an ink cartridge manufacturer, or by an end user. However, rather than manually resetting the chipset at each subsequent ink refill operation, a starting value is instead reset automatically upon, for example, electrical decoupling of the chipset from the printing device. Therefore, the operations at 704 and 706 may be omitted in ink refill operations with respect to embodiments of a cartridge including an ARC chipset.

In addition to a starting value, one or more ink volume warning values ('warning value') can also be determined, at 708. A warning value can also be stored (e.g., set) at the memory chip, at 710, in any of the same ways as described above relative to storing the starting value. A warning value can be selected to represent one or more ink levels at which a user can be warned that a volume of ink in an ink cartridge is low or empty, and that replacement and/or refilling of the ink cartridge is or soon will be required. The use of warning values is optional in at least one embodiment, and is discussed in greater detail below.

In much the same way as a starting value is permanently stored as a default value in one or more embodiments of an ARC as described above, one or more of the warning values are also permanently stored in chipset memory circuitry in one or more embodiments of an ARC. Therefore, the operations at 708 and 710 may be omitted in ink refill operations with respect to embodiments of a cartridge including an ARC chipset.

Once a starting value and/or one or more warning values are determined and set, at 712, a cartridge including the resettable chipset is operatively coupled with a printing device configured correspondingly to receive and retain the cartridge. In embodiments featuring a resettable chipset that is detachable from the cartridge, the resettable chipset will generally be coupled with a chipset-retaining portion of the cartridge prior to coupling the cartridge with the printer.

Operatively coupling the resettable chipset with the printer includes placing electrical contacts of the chipset into electrical communication with corresponding electrical contacts of a printer/cartridge interface bus of the printer. Ordinarily, a printer/cartridge interface bus will include two or more ink presence signal lines (e.g., wires, conductive traces, etc.) electrically coupled during use with an ink level sensor 72 located at least partially within an ink cartridge. Because ink is typically electrically conductive, an electrical signal conveyed to the ink sensor by one signal line will conduct through ink in the cartridge, and return via at least a second ink presence signal line. Therefore, when a return signal is detected due to electrical continuity throughout the ink presence signal circuit, ink is determined to be present in the cartridge. When the ink level drops below the level of the ink sensor, continuity through the ink presence signal circuit is lost, and the ink level in the cartridge is determined to be low or empty.

However, in embodiments of the invented chipset and cartridge, the RAC or ARC includes an electrically conductive circuit path configured to form a closed circuit between the plural ink presence sensing signal lines of the printer when the cartridge is operatively coupled with the printer. The ink presence sensing signal lines are typically but not exclusively electrically shorted together at the PCB, but may also be shorted in an integrated circuit (IC) or discrete digital or analog device operatively coupled with the PCB. Therefore, rather than a low ink level condition being indicated by an ink level sensor and associated circuitry, a low ink level condition is instead indicated by operations of the cartridge chipset.

Therefore, at 714, for those printers that possess ink presence sensor circuitry, a decision block includes the inquiry, 'Does an ink presence sensor report that ink is present in the cartridge?' This inquiry can be a logical operation performed by the printer, or can be merely conceptual in nature. Inasmuch as the shorted ink presence sensor signal lines of the cartridge, if electrically coupled with the corresponding contacts of the printer, should always return a 'Yes' result to the inquiry at 714, a result of 'No' would indicate that the cartridge is not properly coupled with the printer for operation. Therefore, operation 712 should be repeated to ensure the cartridge is operably coupled with the printer.

However, if the result at 714 is 'Yes', then at 716, the ink volume value stored at the cartridge chipset is compared with the one or more Preset Warning values. If the stored ink volume value does not indicate that a Preset Warning value is reached, in the decision block at 718, then at 720, the ink cartridge is indicated as ready for use by the printer, and printing is enabled.

However, if a result at 718 indicates that one or more ink volume Preset Warning values are reached, then the logic flow proceeds to a decision block, at 722, with the inquiry, 'Is the Preset Warning value a Printing Termination value'? If the result of the inquiry at 722 is 'No', then a Low Ink Level signal is generated, at 724, the ink cartridge is indicated as ready for use by the printer, at 720, and printing is enabled. Upon receipt of a Low Ink Level signal, the printer may present a user-detectable (e.g., audio, visual, tactual) indication that the ink level in the cartridge is low. Because continued printing with a depleted ink level can damage either or both of the ink cartridge and the printer, a Low Ink Level signal provides beneficial information to a user.

In embodiments, a generated Low Ink Level signal can correspond to the preset warning value. For example, a first preset warning value can correspond to an estimated ink level of approximately fifteen percent (15%) of the starting ink volume value, and a connected printer would recognize the corresponding generated Low Ink Level signal as representing an estimated 15% remaining ink volume. Another preset warning value can correspond to an estimated ink level of approximately ten percent (10%), and the connected printer would likewise recognize the corresponding generated Low Ink Level signal as representing an estimated 10% remaining ink volume. Of course, one or more warning values can be preset to indicate nearly any estimated remaining volume(s), and when reached, can likewise generate a corresponding Low Ink Level signal(s), within the contemplated embodiments.

If, however, a 'Yes' result is returned at 722, a 'Terminate Printing' signal is generated, at 726, and printing is disabled. Generally, a user will then decouple the ink cartridge from the printer, at 728, to replace or refill the ink cartridge for continued printing. Terminating an active printing process (e.g., a 'printing job') can be disruptive and wasteful. Therefore, after detecting that a printing termination value has been reached, a printer might continue printing until an active printing job is finished, and then might generate and/or respond to a Terminate Printing signal. Responding generally includes preventing any further printing until the user takes appropriate remedial actions (e.g., replaces the ink cartridge or refills the ink cartridge with ink, etc.).

As mentioned, continuing to send ink dispense signals to a fully depleted (e.g., no ink remaining) cartridge can, in some instances, damage the cartridge and/or the print head of the printer. Therefore, a printing termination value will generally be preset at a level wherein a small amount of ink still remains in the cartridge. For example, a printing termination value can be set to represent approximately one-to-five percent (1-5%) of the starting ink volume value. Of course, a printing termination value can be set at nearly any level relative to a starting value in an embodiment, and can vary based on such factors as the total ink capacity of the cartridge, the average size of print jobs processed by the printer, the amount of ink dispensed at each dispense signal, an availability of alternative printers for processing print jobs, or nearly any other factor intrinsic to printer and/or cartridge function, and/or within the discretion of a user.

Once an ink cartridge is indicated as ready for use, as at 720, printing is enabled. During execution of a print job, a printer typically generates ink dispense signals causing ink to be dispensed from the cartridge. In the exemplary embodiment(s) depicted in FIG. 6, dispense signals are also conveyed through the printer/cartridge interface bus and, at 730, are detected by the chipset.

In response to a detected dispense signal, the chipset logic accesses a starting value stored at 706, and at 732, adjusts (e.g., increments or decrements) the starting value to account for the detected dispense signal. For example, a starting value of 'ten-thousand' (10,000) may be decremented to 'nine thousand, nine hundred and ninety-nine', (9,999). Alternatively, a starting valued of 'zero' (0), for example, may be incremented to 'one' (1). Inasmuch as a dispense signal corresponds to a quantity of ink dispensed from the cartridge, adjusting a stored ink volume value corresponding to each dispense signal ('event') helps maintain a relatively representative (e.g., accurate) estimate of remaining ink volume in the cartridge.

After adjusting the starting value, the newly adjusted ink volume value ('adjusted value') is stored in memory, at 734. The adjusted value can either be stored in place of (e.g., replacing) the starting value, or alternatively, can be stored separately in memory. In either case, for descriptive simplicity and clarity, the adjusted value will be referred to hereinafter as the 'current ink volume value' ('current value').

Thereafter, the operations described above according to 716-734 above are repeated, as indicated according to the several decision blocks, a 'Yes' result is returned at 722, and in response to the operation at 726, further printing with the cartridge is disabled.

In at least one alternative embodiment, once a dispense signal is received by the chipset, the comparison indicated at 716 is performed at a predetermined interval (e.g., once for every 1 to n dispense signals that occur). The predetermined interval can be preset by, for example, a manufacture of the chipset and/or cartridge, by an instruction communicated to the chipset by a printer, or by a user as described above relative to setting the starting value (e.g., a GUI, an input device, etc.).

In the case of a conventional cartridge, upon detection of a dispense count value indicating that the ink level is insufficient for continued printing, the user will typically decouple (e.g., uninstall) the cartridge from the printer, install a replacement cartridge, and resume printing. However, inasmuch as embodiments of the invented cartridges enable a RAC and/or ARC chipset to be detached from one cartridge and attached to another, the chipset need not be discarded along with a depleted conventional cartridge. Rather, the chipset values can be reset as described above, rendering the chipset usable with the same or another ink cartridge.

In the case of a refillable cartridge, upon detection of a dispense count value indicating that the ink level is insufficient for continued printing, the user will typically decouple (e.g., uninstall) the cartridge from the printer. The user can then refill the cartridge with ink, and reinstall the refilled cartridge. If the refillable cartridge includes a RAC chipset, then before reinstalling the cartridge, the user would manually reset one or more of the ink volume and/or warning values. Alternatively, in the case of an ARC chipset, one or more of the afore mentioned values are automatically reset by, for example, one or both of electrically decoupling the chipset from and re-coupling the chipset with a printer.

It should be understood that the above described preset values, signal designations, and responses to detected signal count values are exemplary only, and can vary widely in alternative embodiments, without departing from the spirit and scope of the contemplated embodiments.

Alternative Embodiments

With regard to the above described cartridges and features, the contemplated embodiments further encompass not only ink cartridges having a single ink chamber, chipset, siphon structure, and/or dispense port, for example, but also ink cartridges including a plurality of each. For example, an embodiment configured for dispensing two or more other colors (or types) of ink, can include plural cartridge portions. Each portion can include its own ink chamber, wherein the ink chamber of each cartridge portion is dedicated to one of the two or more colors (or types) of ink. Associated with each of the dedicated chambers will generally also be a dedicated dispense port, fluid inflow port, and/or chipset, although a single chipset can likewise be configured to independently track the ink levels (via independent sets of, for example, starting values, warning values, etc.) of more than one ink chamber of a cartridge.

A printer configured to utilize a multi-chambered ink cartridge will generally be likewise configured to send dispense signals corresponding to each of the plural ink colors, which dispense signals are detectable and distinguishable by the chipset logic. Additionally, independent start values and/or warning levels can be stored corresponding to unique features of each of the plural ink chambers (e.g., capacity, ink viscosity, frequency of use, etc.). Therefore, ink levels can be independently and concurrently monitored for each ink color. When one ink color, for example black, is utilized more than another ink color of the cartridge, such that the volume of the blank ink depletes more rapidly than the other color, a warning signal corresponding to the black ink can be generated even though the ink volume value for the other ink level has not yet reached a warning value.

Further, because one of the several ink colors (or types) may be used more quickly than another, one of the plural ink chambers can be configured with a larger ink capacity than at least another ink chamber in the cartridge. Ink volume starting values and/or warning values for the larger capacity chamber can be correspondingly set to reflect the relatively larger capacity.

Likewise, different portions of a multi-chamber ink cartridge can be configured as any one or more of a conventional cartridge, a refillable cartridge, and/or a CISS cartridge. For example, a dual-use cartridge can include one or more CISS portions and one or more refillable portions. A dual use cartridge may be useful where primarily one ink color or type is used, and in large quantities, but another ink color or type is also used, and the user intends to avoid disposing of used convention ink cartridges.

Alternatively, however, the range of contemplated embodiments includes all possible combinations of cartridge portions in a single cartridge configured as any two or more of conventional, refillable, and/or CISS cartridges, wherein any one or more of the cartridge portions include one or more of the novel features described herein.

Although embodiments are described herein of a cartridge having both a siphon structure and a resettable chipset, or a siphon structure and a fluid input port configured as described, such combinations are not mandatory. For example, an automatically resettable chipset can be utilized with an embodiment of a cartridge that does not include a siphon structure and/or a novel fluid input port as described herein. Likewise, a siphon structure can be utilized in a cartridge having a non-resettable chipset and/or the novel fluid input port. The novel fluid input port is likewise separately usable. In general, the novel features can be used in any combination, as well as independently from one another, according to a contemplated embodiment of the invention. For example, a resettable (automatically or manually resettable) chipset is usable with cartridges that utilize a sponge for ink distribution within an ink chamber, whether such cartridges are conventional or refillable.

In at least one embodiment, a wall of an ink cartridge (e.g., a facing wall) comprises a relatively thin (e.g., relative to at least another wall of the cartridge), typically flexible sheet 8 comprised of a polymer material (e.g., a polymer 'membrane'). The relatively thin facing wall is typically sealingly coupled with one or more peripheral walls at least around its periphery, sealing the ink chamber 4 from ink leakage, air infiltration, or other unintended passage of materials therepast. Examples of suitable polymer materials include, but are not limited to, a nylon/polypropylene composite or polyvinyl chloride (PVC). Such sheet 8 can be either transparent, semi-transparent, opaque (or a combination thereof), and either flexible or rigid, according to alternative embodiments.

Likewise, any of the materials of the cartridge, in particular but not exclusively the one or more peripheral walls and/or facing walls, may be opaque, transparent, semi-transparent, or a combination thereof according to alternative embodiments. Additionally, any structure, portion, or material of the invented cartridge may be formed, according to embodiments, in nearly any color or combination of colors, which can include black, white and/or clear or semi-clear. Such coloration may be implemented by any method, material, or combination thereof as known to those having skill in the art.

In an embodiment, a cartridge includes an inner arrangement of peripheral walls, and an outer arrangement of peripheral walls, with a gap (e.g., a space, void, recess, etc.) disposed between and defined by the inner and outer arrangements of peripheral walls. Generally, when so configured, the inner arrangement of peripheral walls defines the ink chamber of the cartridge. Additionally, at least one portion of the cartridge may be provided with an inner facing wall (e.g., the above described flexible sheet 8) sealingly coupled with the arrangement of inner peripheral walls to further define the ink chamber. The cartridge may be further provided with a relatively rigid cover 9 (e.g., 'cover plate' or 'detachable cover') that is attachable to and detachable from the cartridge housing, and when attached, generally lies outside relative to, and provides protection to, the flexible sheet 8 facing wall (as described above).

The relatively rigid cover 9, in embodiments, further includes attachment features 10 configured to enable detachable coupling with the cartridge housing by any of the same means as described relative to coupling a chipset with the housing. For example, a rigid detachable cover 9 can include one or more attachment features 10 (e.g., tabs, etc.) extending perpendicularly and inwardly therefrom (relative to the cartridge housing when coupled therewith), the attachment features 10 being disposed around and/or proximate to a periphery of the cover 9. In at least one embodiment, the one or more attachment features 10 are configured to align with and insert into a gap formed between inner and outer peripheral walls of a cartridge housing, and to securely but detachably retain the cover 9 proximate and approximately parallel-planar relative to an opposing facing wall of the cartridge housing. By 'relatively rigid', it is meant that the cover 9 generally retains its structural shape under normal use conditions (e.g., in the absence of structural damage thereto).

From the above description, one having ordinary skill in the relative art will appreciate that the invented embodiments provide a more environmentally friendly ink cartridge apparatus, method, and system than existing sponge-containing cartridges. The described embodiments may variably include numerous novel features utilized either individually, collectively, or in nearly any combination in an improved ink cartridge. Such embodiments generally may have a higher ink capacity and/or longer life than prior art ink cartridges. Additionally, the described embodiments may be implemented as either a conventional ink cartridge, a refillable ink cartridge, or as part of a Continuous Ink Supply System, with only minor or no alterations during manufacturing. Further still, the described automatically-resettable chipset greatly simplifies re-use of cartridges, obviating the need for auxiliary chipset reset devices, and is detachable in an embodiment from the ink cartridge itself. These benefits represent just a sample of the advancements provided by the described embodiments, and many more benefits and advantages will be recognized by those having skill in the art in light of the descriptions provided herein.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Finally, those of skill in the art will appreciate that the invented method, system and apparatus described and illustrated herein may be implemented in and/or utilizing software, firmware or hardware, or any suitable combination thereof. Preferably, at least one embodiment of the method, system and apparatus is implemented in a combination of the three, for purposes of low cost and flexibility.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. An ink delivery apparatus, comprising:

a housing comprising one or more walls defining a chamber therein;

a fluid dispensing port extending through a first wall of the housing; and a siphon structure comprising plural, contiguous, curved fluid-conducting conduits, each conduit including a bend with an apex, the siphon structure being configured, when the siphon structure is operating, for fluid to flow upward toward each apex and downward away from each apex and for fluid to flow through the plurality of conduits beginning with an intake end, disposed within the chamber, of an intake leg of a first conduit of the plurality and ending at an output end, disposed at the fluid dispensing port, of an output leg of a last conduit of the plurality.

2. The ink delivery apparatus of claim 1, wherein the fluid dispensing port comprises a portion of the output leg.

3. The ink delivery apparatus of claim 1, further comprising:

a fluid input port disposed at and extending through a second wall of the housing, wherein one or more partitions thereof define a substantially unidirectional fluid passage within the chamber.

4. The ink delivery apparatus of claim 3, wherein the fluid input port includes a fluid input duct that is at least partly disposed between the second wall and the unidirectional fluid passage, and wherein a cross-sectional area of the fluid input duct at its junction with the unidirectional fluid passage is substantially smaller than a corresponding cross-sectional area of the unidirectional fluid passage.

5. The ink delivery apparatus of claim 4, wherein the fluid input port extends from a first end proximate to or within the second wall to a second end disposed at a filtering medium.

6. The ink delivery apparatus of claim 1, further comprising:

a resettable electronic device having electrically-conductive contacts configured to couple in electrical communication with and receive an electrical signal from a printing device, and further comprising memory circuitry configured to store one or both of an ink volume value and one or more preset warning values.

7. The ink delivery apparatus of claim 6, wherein the resettable electronic device includes circuitry configured to automatically reset a stored ink volume value upon electrical decoupling of the electrically-conductive contacts from the printing device.

8. The ink delivery apparatus of claim 6, wherein the resettable electronic device includes an electrically conductive circuit path configured to close a circuit between plural ink presence sensing signal lines from a printer when the ink delivery apparatus is operatively coupled with a printer.

9. The ink delivery apparatus of claim 6, wherein a wall of the housing includes a retaining structure configured to couple with and detachably retain the resettable electronic device.

10. The ink delivery apparatus of claim 1, further comprising:

a selectively closable fluid refill port.

11. The ink delivery apparatus of claim 1, further comprising:

a spring-loaded latching member configured to dislocate linearly along a long axis thereof in response to a force applied by a user, and further configured to detachably engage with a corresponding structure of a printer.

12. The ink delivery apparatus of claim 1, wherein the one or more walls comprise an inner arrangement of peripheral walls, wherein the cartridge further includes an outer arrangement of peripheral walls, and wherein the inner and outer arrangements of peripheral walls define a gap therebetween.

13. The ink delivery apparatus of claim 1, including any one or more of:

a detachable, automatically-resettable electronic ink-volume tracking device;

a detachable cover plate; and a detachable, spring-loaded latching mechanism configured to couple the cartridge in an operative engagement with a printer.

14. The ink delivery apparatus of claim 1, further comprising:

a selectively closable refill port disposed through a wall of the one or more walls; and an automatically resettable electronic device coupled at a wall of the one or more walls.

15. The ink delivery apparatus of claim 14, wherein the automatically resettable electronic device comprises an integrated circuit device coupled in electrical communication with a printed circuit board, and wherein the printed circuit board includes one or more electrical contacts presented outwardly from the housing relative to the chamber.

16. The ink delivery apparatus of claim 14, wherein the automatically resettable electronic device is configured to reset a ink volume value stored therein upon electrical decoupling of one or more electrical contacts from a printing device.

17. The ink delivery apparatus of claim 14, wherein the automatically resettable electronic device includes an electrically conductive circuit path configured to form a closed circuit between plural ink presence sensing signal lines from a printer when the ink delivery apparatus is operatively coupled with a printer.

18. The ink delivery apparatus of claim 14, wherein the fluid input port extends from a first end proximate to or within the wall through which it is disposed to a second end disposed at a filtering medium.

19. The ink delivery apparatus of claim 14, including any one or more of:

a detachable, automatically-resettable electronic ink-volume tracking device;

a detachable cover plate; and a detachable latch mechanism configured to couple the cartridge in an operative engagement with a printer.

20. The ink delivery apparatus of claim 1, further comprising an automatically-resettable electronic device, the automatically-resettable electronic device comprising:

volatile memory circuitry configured with one or more predetermined ink volume values stored thereat;

processor circuitry;

a printed circuit board having an integrated circuit device electrically coupled at a surface thereof, wherein the integrated circuit device includes one or both of the memory circuitry and the processor circuitry;

one or more first electrical contacts disposed at a surface of the printed circuit board, the one or more first electrical contacts being configured and arranged to conductively couple with one or more corresponding second electrical contacts of a printer; and supporting structure configured to retain the printed circuit board, and further configured to detachably couple with the housing, wherein the one or more first electrical contacts are configured, when operatively coupled with the printer, to electrically couple with the one or more corresponding second electrical contacts.

21. The ink delivery apparatus of claim 20, wherein the electronic device is configured to detect an electrical signal corresponding to a printing operation of the printer, and in response to the detected electrical signal, to either or both of incrementally and decrementally adjust the one or more predetermined ink volume values stored in the memory circuitry, and to store the one or more adjusted predetermined ink volume values in the memory circuitry.

22. The ink delivery apparatus of claim 20, wherein the electronic device is configured to automatically reset an adjusted value stored in the memory circuitry to the one or more predetermined ink volume values in response to either of electrically coupling the one or more first electrical contacts of the electronic device with, or electrically decoupling the one or more first electrical contacts of the electronic device from, the one or more corresponding second electrical contacts.

23. The ink delivery apparatus of claim 20, wherein the first electrical contacts comprise a plurality of contacts configured as either or both of asymmetrical and symmetrical grid-wise-orthogonal overlapping shapes.

24. The ink delivery apparatus of claim 1, wherein the intake end is elevated relative to the output end, when the siphon structure is positioned for operation.

25. The ink delivery apparatus of claim 1, wherein at least one of the apexes of the plurality of conduits is elevated relative to both of the intake end and the output end, when the plurality of conduits is positioned for operation.

26. A method of preparing a spongeless ink cartridge for use with a printing device, comprising:

providing an ink cartridge configured to detachably and operatively couple with a printing device, wherein the ink cartridge comprises:

a housing comprising one or more walls defining a chamber therein:

a fluid dispensing port extending through a first wall of the housing; and a siphon structure comprising plural, contiguous, curved fluid-conducting conduits, each conduit including a bend with an apex, the siphon structure being configured, when the siphon structure is operating, for fluid to flow upward toward each apex and downward away from each apex and for fluid to flow through the plurality of conduits beginning with an intake end, disposed within the chamber, of an intake leg of a first conduit of the plurality and ending at an output end, disposed at the fluid dispensing port, of an output leg of a last conduit of the plurality, and disposing a liquid ink within the chamber.

27. The method of claim 26, wherein the cartridge further comprises:

a fluid input port disposed through another of the one or more walls, wherein the fluid input port extends from a first end proximate to or within the wall through which it is disposed to a second end disposed at a filtering medium.

28. The method of claim 26, further comprising:

providing a resettable electronic device coupled at one of the one or more walls.

29. The method of claim 28, wherein the resettable electronic device is detachable from the wall at which it is disposed.

* * * * *